US007201646B1

(12) United States Patent
Patton

(10) Patent No.: US 7,201,646 B1
(45) Date of Patent: Apr. 10, 2007

(54) TENSION ADJUSTMENT APPARATUS FOR ABRADING TOOLS

(76) Inventor: Richard C. Patton, 5622 Emmaus Rd., Emmaus, PA (US) 18049

( * ) Notice: Subject to any disclaimer, the term of this patent is extended or adjusted under 35 U.S.C. 154(b) by 0 days.

(21) Appl. No.: 11/334,836

(22) Filed: Jan. 19, 2006

(51) Int. Cl.
*B24D 9/02* (2006.01)

(52) U.S. Cl. ..... 451/504; 451/513; 451/523

(58) Field of Classification Search ..... 451/504, 451/514, 517, 519, 523, 524, 513, 521
See application file for complete search history.

(56) References Cited

U.S. PATENT DOCUMENTS 2,400,928 A * 5/1946 Hein ..... 451/504
2,761,257 A * 9/1956 Mendelsohn ..... 451/504
3,063,208 A * 11/1962 Bell et al. ..... 451/504
3,510,991 A * 5/1970 Bowen ..... 451/504
3,562,967 A * 2/1971 Eriksen ..... 451/504
3,601,933 A * 8/1971 Bowen ..... 451/504
5,172,524 A * 12/1992 Poss ..... 451/504
5,183,441 A 2/1993 Urda
5,383,308 A * 1/1995 Beloff et al. ..... 451/519
6,174,226 B1 1/2001 Frech et al.
6,475,075 B1 11/2002 Wuensch
6,537,142 B2 3/2003 Liou

* cited by examiner

*Primary Examiner*—Dung Van Nguyen
(74) *Attorney, Agent, or Firm*—James Ray & Assoc.

(57) ABSTRACT

A tension adjustment apparatus for a sander includes a first rigid portion and an opposed second rigid portion. A pair of elongated members are attached to the second portion and slideably received within the first portion. A pair of edge cavities are provided within the first portion each exposing a portion of the elongated member having a notch. A wheel is disposed within each edge cavity and caged by the notch of such elongated member. The wheel has axially disposed threaded apertures engaging a threaded fastener employed for attaching the wheel to the first portion for enabling linear motion of the elongated member and a corresponding linear motion of the second portion in a first direction away from the first portion to apply a predetermined tension in a sanding element and in a second linear direction towards the first portion to release the applied tension during reciprocal rotation of the wheels.

10 Claims, 1 Drawing Sheet

TENSION ADJUSTMENT APPARATUS FOR ABRADING TOOLS

FIELD OF THE INVENTION

The present invention relates, in general, to abrading tools and, more particularly, this invention relates to a tension adjustment apparatus for use with abrading tools such as a hand held sanding block, hand held power belt sander and a stationary power belt sander.

BACKGROUND OF THE INVENTION

Hand held sanding blocks and power hand held and stationary sanders are well known in the art of abrading tools. One type of hand held sanding block is used with an elongated strip of sand paper and is provided with retaining means, such as spikes or clamps, at each end to cage opposed ends of such elongated strip. Another type of the hand held sanding block is used with a continuous sanding belt.

The disadvantage of the presently used sanding blocks is that the installation of the elongated sanding strip requires a considerable manual effort in order to achieve proper tension therein. Such manual effort may cause an undesirable strain and fatigue during frequent changes of the elongated sanding strips.

When the hand held sanding block is used with a continuous sanding belt, a tension mechanism must be employed in order to achieve proper tension in such continuous sanding belt. U.S. Pat. No. 6,196,909 to Cadrobbi discloses a separate wedge inserted between the belt and the block and slideable along the block until proper tension is achieved. The disadvantage of such prior art is that the wedge may be easily misplaced during storage or shift during use.

U.S. Pat. No. 6,663,479 to Sendelbeck discloses another type of tension mechanism for a hand held sanding block wherein a two portion swivel block is employed and wherein such portions are rotatable about one another in one direction to apply tension and in the opposite direction to release the tension. The disadvantage of such tension mechanism is that when the tension is achieved, one portion extends beyond the edges of another portion resulting in increased size of the sanding block.

The powered sanders are primarily used with continuous sanding belts and employ a driving element such as a pulley or a wheel connected to a prime mover such as an electric motor and a driven element connected to the driving element with a rigid linkage or a frame. The driving and driven elements are directly or indirectly engaged with the sanding belt and enable rotary motion thereof upon activation of the prime mover.

Various belt tensioning devices disclosed in U.S. Pat. No. 6,537,142 to Liou; U.S. Pat. No. 6,475,075 to Wuensch; U.S. Pat. No. 6,299,512 to Costa et al; U.S. Pat. No. 6,174,226 to Frech et al; and U.S. Pat. No. 5,183,441 to Urda utilize complex linkages and levers in order to apply and release tension in the continuous sanding belt.

Therefore, there is a need for an improved simple and economical apparatus for use with one of a hand held sanding block and a power sander for applying and releasing tension in one of the elongated sanding strip and continuous sanding belt.

SUMMARY OF THE INVENTION

The invention provides a tension adjustment apparatus for use with a hand held sanding block and a power sander. The tension adjustment apparatus includes a first rigid portion and an opposed second rigid portion. A pair of elongated members are attached to the second rigid portion and are slideably received within the first rigid portion. A pair of edge cavities are provided within the first rigid portion each exposing a portion of the elongated member having a notch. A wheel is disposed within each edge cavity and caged by the notch of such elongated member. Each wheel has an axially disposed threaded aperture engaging a threaded fastener employed for attaching the wheel to the first rigid portion for enabling linear motion of the wheel during rotation thereof. Such linear motion of each wheel causes linear motion of the elongated member and a corresponding linear motion of the second rigid portion in a first direction away from the first rigid portion to apply a predetermined tension in a sanding element and in a second linear direction towards the first rigid portion to release the applied tension. A first cross slit is formed in the first rigid portion adjacent its free end and a second cross slit is formed in the second rigid portion adjacent its free end for using the hand held sander with an elongated sanding strip wherein one end of the elongated sanding strip is caged within the first cross slit and a second end is caged within the second cross slit.

OBJECTS OF THE INVENTION

It is, therefore, one of the primary objects of the present invention to provide a tension adjustment apparatus for use with abrading tools.

Another object of the present invention is to provide a tension adjustment apparatus for use with hand held and power abrading tools.

Yet another object of the present invention is to provide a tension adjustment apparatus for use with an elongated sanding strip and a continuous sanding belt.

A further object of the present invention is to provide a tension adjustment apparatus which is simple to use.

Yet a further object of the present invention is to provide a tension adjustment apparatus which is economical to manufacture.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
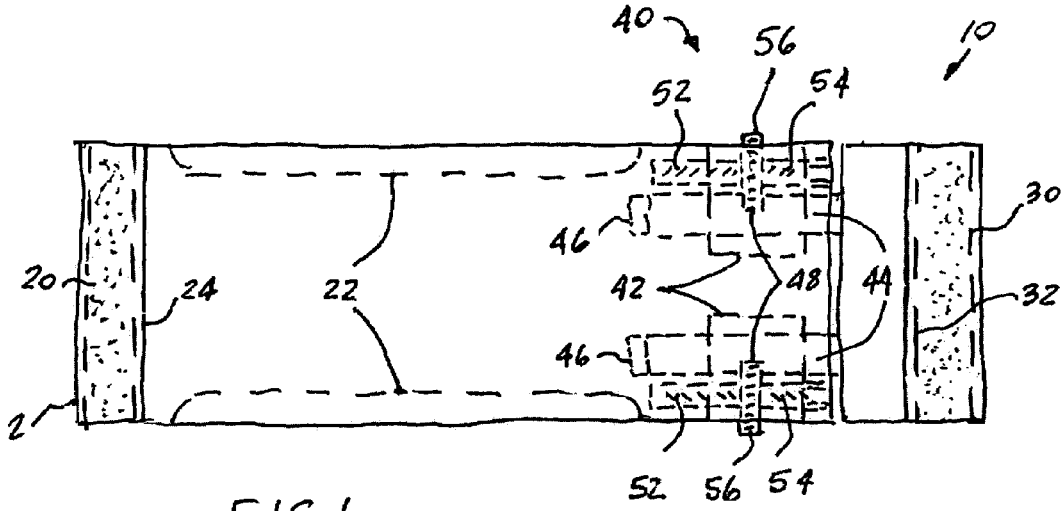
FIG. 1 is a plan view of a presently preferred tension adjustment apparatus of the invention for use with a hand held sanding block.

Prior to proceeding to the more detailed description of the present invention, it should be noted that, for the sake of clarity and understanding, identical components which have identical functions have been identified with identical reference numerals throughout the several views illustrated in the drawing figures.

Figure 2:
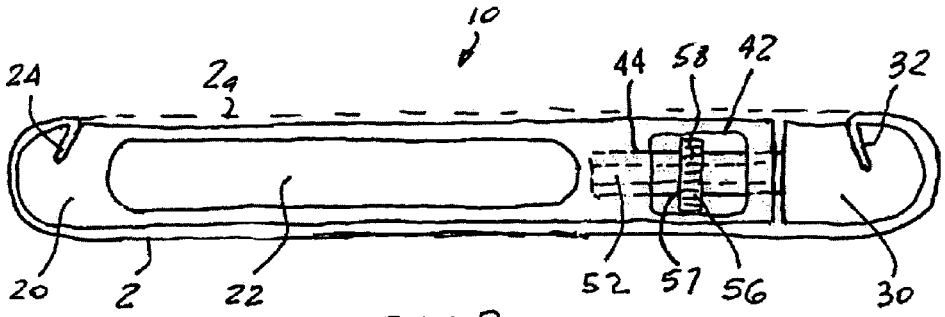
FIG. 2 is a side elevation view of the tension adjustment apparatus of FIG. 1.

Reference is now made, to FIGS. 1–2, wherein there is shown a hand held sander, generally designated 10, for use with an abrading working element, such as a continuous sanding belt 2*a*. The hand held sander 10 includes a first body portion 20 having each of a predetermined width, predetermined length and predetermined thickness and a second body portion 30 which is disposed opposite the first body portion 10 and has each of such predetermined width and predetermined thickness. There is a means, generally designated 40, which is engageable with the first body portion 20 and the second body portion 30 and manually operable for selectively moving the second body portion 30 in a first linear direction away from the first body portion 20 for applying a predetermined tension in such continuous sanding belt 2*a* and in a second linear direction towards the first body portion 20 for releasing the predetermined tension applied within such continuous sanding belt 2*a*.

In the presently preferred embodiment of the invention, a first essential element of the tension means 40 is a pair of cavities 42 each formed in a respective side edge of the first body portion 20.

Another essential element is a pair of wheels 56 each disposed within a respective cavity 42.

Yet, another essential element of the tension means 40 is a rigid means 44 slideably engageable with the first body portion 20 and attached to the second body portion 30. Such rigid means 44 is provided for moving the second body portion 30 in the first and the second direction and for maintaining planar relationship of the first and the second body portion, 20 and 30 respectively. Preferably, the rigid means 44 is a pair of elongated members 44 mounted in a parallel spaced relationship, each having a predetermined cross-section slideably received within a cavity 46 of the first body portion 20 and a notch 48 formed perpendicular to a longitudinal axis of each elongated member 44 and disposed within a respective cavity 42 for caging a respective one of the pair of wheels 56.

A pair of attachment means 52, each engageable with the first body portion 20 and having a threaded portion 54, are disposed within a respective one of the pair of cavities 42. Advantageously, each of such pair of attachment means 52 is a threaded fastener 52.

Each wheel 56 has a threaded aperture 57 axially disposed therein for threadedly engaging the threaded portion 54 of a respective one of the pair of attachment means 52. Since the notch 48 of the elongated member 44 cages the wheel 56, manual reciprocal rotation of the wheel 56 causes linear movement thereof enabled by the threaded portion 54 of the respective one attachment means 52 and further causes a corresponding linear movement of the elongated member 44 enabling movement of the second body portion 30 in the first and the second linear directions.

In operation, when a new continuous sanding belt 2*a* is loosely positioned over the first and second body portions 20 and 30 respectively, the wheels 56 are rotated, preferably simultaneously, to move the second body portion 30 in the first linear direction away from the first body portion 20 until a predetermined tension is applied within the continuous sanding belt 2*a*. To remove the continuous sanding belt 2*a*, the wheels 56 are rotated in an opposite direction to move the second body portion 30 in the second linear direction towards the first body portion 20 until such predetermined tension is released and the continuous sanding belt 2*a* can be easily removed.

To provide for ease of belt installation and removal within a working environment, each of the pair of wheels 56 includes an anti-slip means 58 which is a predetermined plurality of knurls or serrations 58 disposed on the peripheral edge of the wheel 56.

Advantageously, the hand held sander 10 may include a grip means 22 disposed in at least one of the first body portion 20 and the second body portion 30. Preferably, the grip means 22 is an elongated cavity 22 formed in at least one side edge of the at least one of the first body portion 20 and the second body portion 30.

It will be appreciated that the material of the first body portion 20 and the second body portion 30 may be one of wood, metal, elastomer, thermoplastic and various combinations thereof.

In applications wherein such abrading working element is a well known elongated sanding strip 2, the hand held sander 10 includes a first cross slit 24 formed in the first body portion 20 adjacent its free end and a second cross slit 32 formed in the second body portion 30 adjacent its free end. The first end of the elongated sanding strip 2 is caged within the first cross slit 24 and the second end is caged within the second cross slit 32. Preferably, at least one of the first cross slit 24 and the second cross slit 32 is angularly and outwardly oriented, as best shown in FIG. 2, to aid in retaining the elongated sanding strip 2.

It will be apparent to those skilled in the art that the hand held sander 10 having first cross slit 24 and the second cross slit 32 can be further used with the continuous sanding belt 2*a*.

Figure 3:
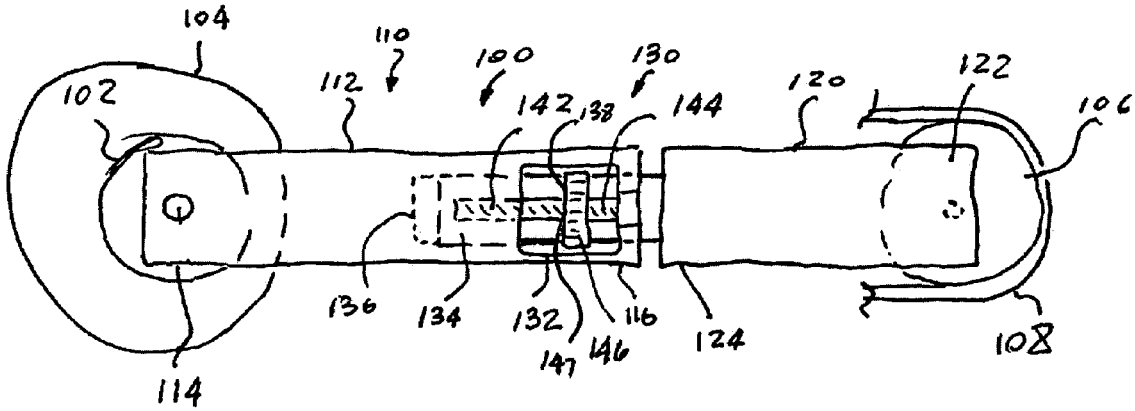
FIG. 3 is a side elevation view of a presently preferred tension adjustment apparatus of the invention for use with a power sander.

Now in a particular reference to FIG. 3, therein shown is a tension apparatus, generally designated 110, for use with a powered belt sander, generally designated 100, having at least a driving element 102 actuated by a prime mover 104, an oppositely disposed driven element 106, and a continuous sanding belt 108 arranged on the driving and the driven element 102 and 106 respectively.

Such tension apparatus 110 includes a first rigid portion 112 having one end 114 adapted for rotatably receiving the driving element 102 and having an opposed end 116 extending towards the driven element 106.

A second rigid portion 120 has one end 122 adapted for rotatably receiving the driven element 106 and having an opposed end 124 extending towards the driving element 102.

A manually operable means, generally designated 130, is engaged with the first rigid portion 112 and the second rigid portion 120 for selectively moving the first and the second rigid portion, 112 and 120 respectively, in a first direction away from one another for applying a predetermined tension in such continuous sanding belt 108 and in a second direction towards one another for releasing the predetermined tension applied within such continuous sanding belt 108.

Such manually operable means 130 includes a pair of cavities 132 each formed in a respective side edge of the first rigid portion 112.

A pair of wheels 146 is provided, each disposed within the respective cavity 132.

A rigid means 134 slideably engageable with the first rigid portion 112 and attached to the second rigid portion 120 is provided for moving the second rigid portion 120 in the first and the second direction and for maintaining planar relationship of the first and the second body portion, 20 and 30 respectively. Preferably, the rigid means 134 is a pair of elongated members 134 mounted in a parallel spaced relationship, each having a predetermined cross-section slideably received within a cavity 136 of first rigid portion 112 and a notch 138 formed perpendicular to a longitudinal axis of each elongated member 134 to cage a respective one of the pair of wheels 146.

A pair of attachment means 142, each engageable with the first rigid portion 112 and having a threaded portion 144, are disposed within a respective one of the pair of cavities 132. Advantageously, each of such pair of attachment means 142 is a threaded fastener 142.

Each wheel 146 has a threaded aperture 147 axially disposed therein for threadedly engaging the threaded portion 144 of a respective one of the pair of attachment means 142. Since the notch 138 of the elongated member 134 cages the wheel 146, manual reciprocal rotation of the wheel 146 causes linear movement thereof enabled by the threaded portion 144 of a respective attachment means 142 and further causes a corresponding linear movement of elongated member 134 enabling movement of the second rigid portion 120 in the first and the second linear direction.

It will be apparent to those of ordinary skilled in the art that the tension apparatus 110 may be used with a power belt sander 110 being one of a hand held power belt sander and stationary mounted power belt sander.

It will be further apparent to those of ordinary skilled in the art that the tension mechanism 110 may be employed with an oscillating type power sander 100 utilizing an elongated sanding strip.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A hand held sander for use with a continuous sanding belt, said hand held sander comprising:

(a) a first body portion having each of a predetermined width, a predetermined length and a predetermined thickness;

(b) a second body portion having said each of said predetermined width and said predetermined thickness; and (c) means engageable with said first body portion and said second body portion and operable for selectively moving said second body portion in a first linear direction away from said first body portion for applying a predetermined tension in such continuous sanding belt and in a second linear direction towards said first body portion for releasing said predetermined tension applied within such continuous sanding belt, said tension means including:

(i) a pair of cavities each formed in a respective side edge of said first body portion which is parallel to each of said first and said second linear direction, (ii) a pair of elongated members mounted in a parallel spaced relationship each slideably engageable with said first body portion and attached to said second body portion for moving said second body portion in said first and said second direction and for maintaining a planar relationship of said first and said second body portion, (iii) a pair of notches each formed within a respective one of said pair of elongated members and positioned within a respective one of said pair of cavities of said first body portion, (iv) a pair of attachment means each engageable with said first body portion and having a threaded portion thereof disposed within said respective one of said pair of cavities, and (v) a pair of wheels each having a threaded aperture axially disposed therein for threadably engaging said threaded portion of a respective one of said pair of attachment means, said each of said pair of wheels is disposed within said respective cavity formed in said first body and is caged by a respective one of said pair of notches, whereby a reciprocal rotation of said each of said pair of wheels causes a linear movement thereof enabled by said threaded portion and further causes a linear movement of said pair of elongated members enabling movement of said second body portion in said first and said second linear direction.

2. The hand held sander, according to claim 1, wherein each of said pair of attachment means is a threaded fastener.

3. The hand held sander, according to claim 1, wherein each of said pair of wheels includes an anti-slip means.

4. The hand held sander, according to claim 3, wherein said anti-slip means is one of a knurled peripheral edge and a serrated peripheral edge.

5. The hand held sander, according to claim 1, wherein said hand held sander further includes a first cross slit formed in said first body portion adjacent its free end and a second cross slit formed in said second body portion adjacent its free end for using said hand held sander with an elongated sanding strip having one end caged within said first cross slit and having a second end caged within said second cross slit.

6. The hand held sander, according to claim 5, wherein at least one of said first cross slit and said second cross slit is angularly and outwardly oriented.

7. The hand held sander, according to claim 1, wherein said hand held sender further includes a grip means disposed in at least one of said first body portion and said second body portion.

8. The hand held sander, according to claim 7, wherein said grip means is an elongated cavity formed in at least one side edge of said at least one of said first body portion and said second body portion.

9. The hand held sander, according to claim 1, wherein a material of said first body portion and said second body portion is one of wood, metal, elastomer, thermoplastic and various combinations thereof.

10. A hand held sander for use with an elongated sanding strip, said hand held sander comprising:

(a) a first body portion having each of a predetermined width, a predetermined length and a predetermined thickness;

(b) a second body portion having said each of said predetermined width and said predetermined thickness;

(c) a first cross slit formed in said first body portion adjacent its free end for caging a first end of such elongated sanding strip;

(d) a second cross slit formed in said second body portion adjacent its free end for caging an opposed end of such elongated sanding strip; and (d) means engageable with said first body portion and said second body portion and operable for selectively moving said second body portion in a first linear direction away from said first body portion for applying a predetermined tension in such elongated sanding strip and in a second linear direction towards said first body portion for releasing said predetermined tension applied within such elongated sanding strip, said tension means including:

(i) a pair of cavities each formed in a respective side edge of said first body portion which is parallel to each of said first and said second linear direction, (ii) a pair of elongated members mounted in a parallel spaced relationship each slideably engageable with said first body portion and attached to said second body portion for moving said second body portion in said first and said second direction and for maintaining a planar relationship of said first and said second body portion, (iii) a pair of notches each formed within a respective one of said pair of elongated members and positioned within a respective one of said pair of cavities of said first body portion, (iv) a pair of attachment means each engageable with said first body portion and having a threaded portion thereof disposed within said respective one of said pair of cavities, and (v) a pair of wheels each having a threaded aperture axially disposed therein for threadably engaging said threaded portion of a respective one of said pair of attachment means, said each of said pair of wheels is disposed within said respective cavity formed in said first body and is caged by a respective one of said pair of notches, whereby a reciprocal rotation of said each of said pair of wheels causes a linear movement thereof enabled by said threaded portion and further causes a linear movement of said pair of elongated members enabling movement of said second body portion in said first and said second linear direction.

* * * * *